US009097087B2

(12) United States Patent
Hallundbæk

(10) Patent No.: US 9,097,087 B2
(45) Date of Patent: Aug. 4, 2015

(54) FAIL-SAFE SPRING

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 14/008,365

(22) PCT Filed: Mar. 29, 2012

(86) PCT No.: PCT/EP2012/055641
§ 371 (c)(1),
(2), (4) Date: Sep. 27, 2013

(87) PCT Pub. No.: WO2012/130942
PCT Pub. Date: Oct. 4, 2012

(65) Prior Publication Data

US 2014/0014322 A1 Jan. 16, 2014

(30) Foreign Application Priority Data

Mar. 30, 2011 (EP) ..... 11160492

(51) Int. Cl.
*E21B 23/04* (2006.01)
*E21B 23/14* (2006.01)
(Continued)

(52) U.S. Cl.
CPC ..... *E21B 23/14* (2013.01); *E21B 17/1021* (2013.01); *E21B 23/04* (2013.01); *E21B 2023/008* (2013.01)

(58) Field of Classification Search
CPC ..... E21B 17/1021
USPC ..... 166/212
See application file for complete search history.

(56) References Cited

U.S. PATENT DOCUMENTS 2,332,749 A * 10/1943 Page ..... 166/212
3,177,938 A 4/1965 Rene
(Continued)

FOREIGN PATENT DOCUMENTS

WO WO 93/18277 9/1993
WO WO 2006/115418 11/2006
(Continued)

OTHER PUBLICATIONS

International Search Report for PCT/EP2012/055641, mailed May 7, 2012.
(Continued)

*Primary Examiner* — Giovanna C Wright
(74) *Attorney, Agent, or Firm* — Nixon & Vanderhye P.C.

(57) ABSTRACT

The present invention relates to a downhole tool extending in a longitudinal direction, comprising a tool housing; an arm assembly movable between a retracted position and a projecting position in relation to the tool housing; an arm activation assembly for moving the arm assembly between the retracted position and the projecting position; wherein the arm activation assembly comprises: a piston housing comprising a piston chamber, said piston chamber extending in the longitudinal direction of the downhole tool, a piston member arranged inside the piston chamber and engaged with the arm assembly to move the arm assembly between the retracted position and the projecting position, the piston member being movable in the longitudinal direction of the downhole tool and having a first piston face and a second piston face, the piston member being able to apply a projecting force on the arm assembly by applying a hydraulic pressure on the first piston face moving the piston in a first direction, and a spring member applying a spring force to move the piston in a second direction opposite the first direction. Furthermore, the invention relates to a downhole system.

18 Claims, 13 Drawing Sheets

(51) Int. Cl.
*E21B 17/10* (2006.01)
*E21B 23/00* (2006.01)

(56) References Cited

U.S. PATENT DOCUMENTS

| | | | | |
|---|---|---|---|---|
| 3,831,443 | A * | 8/1974 | Planche | 73/152.54 |
| 4,819,760 | A * | 4/1989 | Petermann | 181/102 |
| 5,242,020 | A * | 9/1993 | Cobern | 166/254.2 |
| 6,629,568 | B2 | 10/2003 | Post et al. | |
| 2007/0181298 | A1 | 8/2007 | Sheiretov et al. | |
| 2009/0223659 | A1 | 9/2009 | Hill et al. | |
| 2010/0012315 | A1 | 1/2010 | McInally | |
| 2012/0037358 | A1 | 2/2012 | Ferkingstad et al. | |
| 2012/0273238 | A1* | 11/2012 | Boekholtz et al. | 166/383 |

FOREIGN PATENT DOCUMENTS

| | | |
|---|---|---|
| WO | WO 2008/091157 | 7/2008 |
| WO | WO 2008/111844 | 9/2008 |
| WO | WO 2009/020397 | 2/2009 |
| WO | WO 2009/111693 | 9/2009 |
| WO | WO 2010/123375 | 10/2010 |

OTHER PUBLICATIONS

Written Opinion of the International Searching Authority for PCT/EP2012/055641, mailed May 7, 2012.

International Preliminary Report on Patentability issued in International Patent Application No. PCT/EP2012/055641 on Oct. 1, 2013.

* cited by examiner

FAIL-SAFE SPRING

This application is the U.S. national phase of International Application No. PCT/EP2012/055641, filed 29 Mar. 2012, which designated the U.S. and claims priority to Europe Application No. 11160492.2, filed 30 Mar. 2011, the entire contents of each of which are hereby incorporated by reference.

FIELD OF THE INVENTION

The present invention relates to a downhole tool extending in a longitudinal direction, comprising a tool housing; an arm assembly movable between a retracted position and a projecting position in relation to the tool housing; and an arm activation assembly for moving the arm assembly between the retracted position and the projecting position. Furthermore, the invention relates to a downhole system.

BACKGROUND ART

Downhole tools are used for operations inside boreholes of oil and gas wells. Downhole tools operate in a very harsh environment and must be able to withstand inter alia corroding fluids, high temperatures and high pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

Well tools are often part of a larger tool string containing tools with different functionalities. A tool string may comprise both transportation tools for transporting the tool string in the well and operational tools for performing various operations downhole, e.g. centralising tools for centralising the tool or tool string in the borehole, driving units for moving the tool or tool string in the borehole and anchoring tools for anchoring the tool or tool string in the borehole.

The use of tools and/or units with extracting members for engaging the borehole wall has potential risk of jamming in the borehole in case of a breakdown. Extreme conditions such as very high pressures, high temperatures and an acidic environment therefore place high demands on mechanical mechanisms in downhole tools.

The above often results in a minimum use of such tools downhole to avoid unwanted breaks in production times. Therefore, a need exists for downhole tools that are relatively fail-safe and thus extractable from the borehole, also in case of a breakdown.

SUMMARY OF THE INVENTION

It is an object of the present invention to wholly or partly overcome the above disadvantages and drawbacks of the prior art. More specifically, it is an object to provide an improved downhole tool wherein a spring member ensures a fail-safe retraction of extracting members of the downhole tool.

The above objects, together with numerous other objects, advantages, and features, which will become evident from the below description, are accomplished by a solution in accordance with the present invention by a downhole tool extending in a longitudinal direction, comprising:

a tool housing, an arm assembly movable between a retracted position and a projecting position in relation to the tool housing, and an arm activation assembly for moving the arm assembly between the retracted position and the projecting position, wherein the arm activation assembly comprises:

a piston housing comprising a piston chamber, said piston chamber extending in the longitudinal direction of the downhole tool, a piston member arranged inside the piston chamber and engaged with the arm assembly to move the arm assembly between the retracted position and the projecting position, the piston member being movable in the longitudinal direction of the downhole tool and having a first piston face and a second piston face, the piston member being able to apply a projecting force on the arm assembly by applying a hydraulic pressure on the first piston face moving the piston in a first direction, and a spring member applying a spring force to move the piston in a second direction opposite the first direction.

In one embodiment, the arm activation assembly may comprise a fluid channel and the hydraulic pressure may be applied to the first piston face with a pressurised hydraulic fluid such as oil through the fluid channel.

In another embodiment, the spring member may be arranged in a spring chamber and the piston may be arranged in a piston chamber.

Said piston housing may comprise a recess for receiving part of the shaft when the piston moves.

Moreover, the shaft may extend in the piston chamber and into the spring chamber.

Further, the piston member may divide the piston housing into a first and a second section, the first section being filled with fluid for moving the piston member.

The downhole tool according to the invention may further comprise a pump for pressurising the pressurised hydraulic fluid for moving the piston in the first direction.

Additionally, the downhole tool according to the invention may comprise an electrical motor for driving the pump.

In one embodiment, the downhole tool may be connected with a wireline and the electrical motor may be powered through the wireline.

Also, the downhole tool may comprise several arm assemblies and arm activation assemblies and each of the arm assemblies may be moved by one of the arm activation assemblies.

Additionally, the piston chamber and spring chamber may be arranged substantially end-to-end in the longitudinal direction of the tool.

The piston chamber and the spring chamber may be arranged substantially side-by-side in the longitudinal direction of the tool.

In one embodiment, the downhole tool according to the invention may further comprise a control member arranged inside a coil of the spring.

In another embodiment, the piston may comprise a distal part with a reduced diameter engageable with the spring member.

Said spring member may be is a coil spring, a helical spring, a bellows, a volute spring, a leaf spring, a gas spring or a disc spring.

The downhole tool according to the invention may further comprise electrical sensors for monitoring a pressure on the first piston face for producing a feedback signal to a control system.

Moreover, the downhole tool according to the invention may comprise electrical sensors for monitoring a position of the piston member for producing a feedback signal to a control system.

The above-mentioned spring member may be preloaded before being compressed by the piston during application of the hydraulic pressure on the first piston face moving the piston in a first direction.

Also, the piston member may be connected with the arm assembly using a worm shaft, a crank arm or a rack or a pivot joint or a recess in the piston member.

The present invention also relates to a downhole system, comprising:

a wireline, a mating tool such as a driving unit and/or an operational tool, and a downhole tool as described above.

Further, the arm activation assembly of the downhole tool as described above may comprise a crank arm, meaning that when the piston member is moved back and forth in the longitudinal direction of the piston chamber, the piston member will move the crank arm, and when the crank arm is moved, a crank shaft is rotated around a rotation axis, and hence the arm assembly being connected to the crank shaft is moved between a retracted position and a projecting position, and wherein a force arm distance between the rotation axis of the crank arm and a point of contact between the crank arm and the piston member may be longer in the retracted position than in the projecting position, meaning that a resulting projecting force applied to the arm assembly by the arm activation assembly is decreasing from a high resulting projection force in the retracted position towards a lower resulting projection force in the projecting position.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
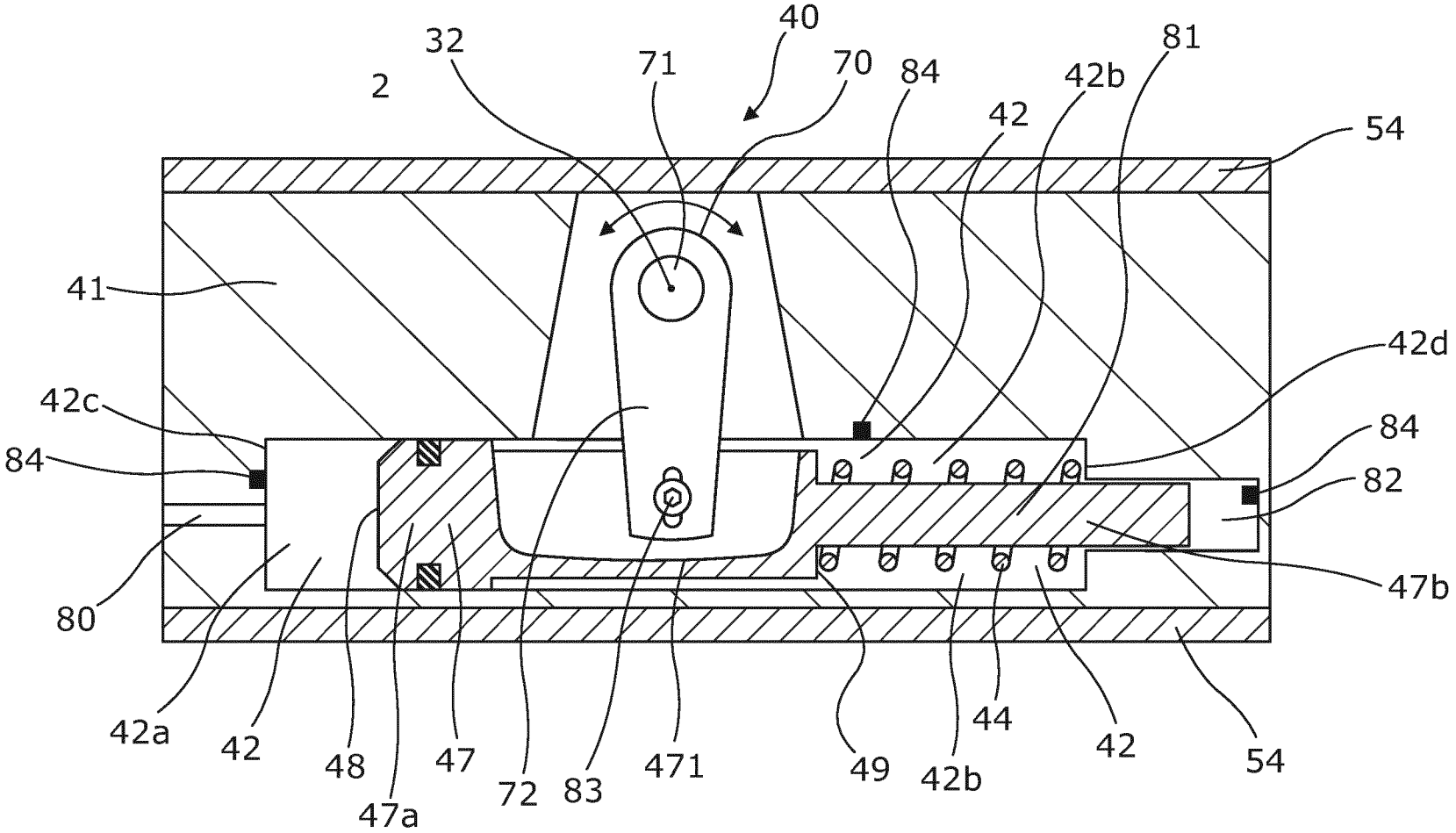
FIG. 1 shows a cross-sectional view of an arm activation assembly.
Figure 6:
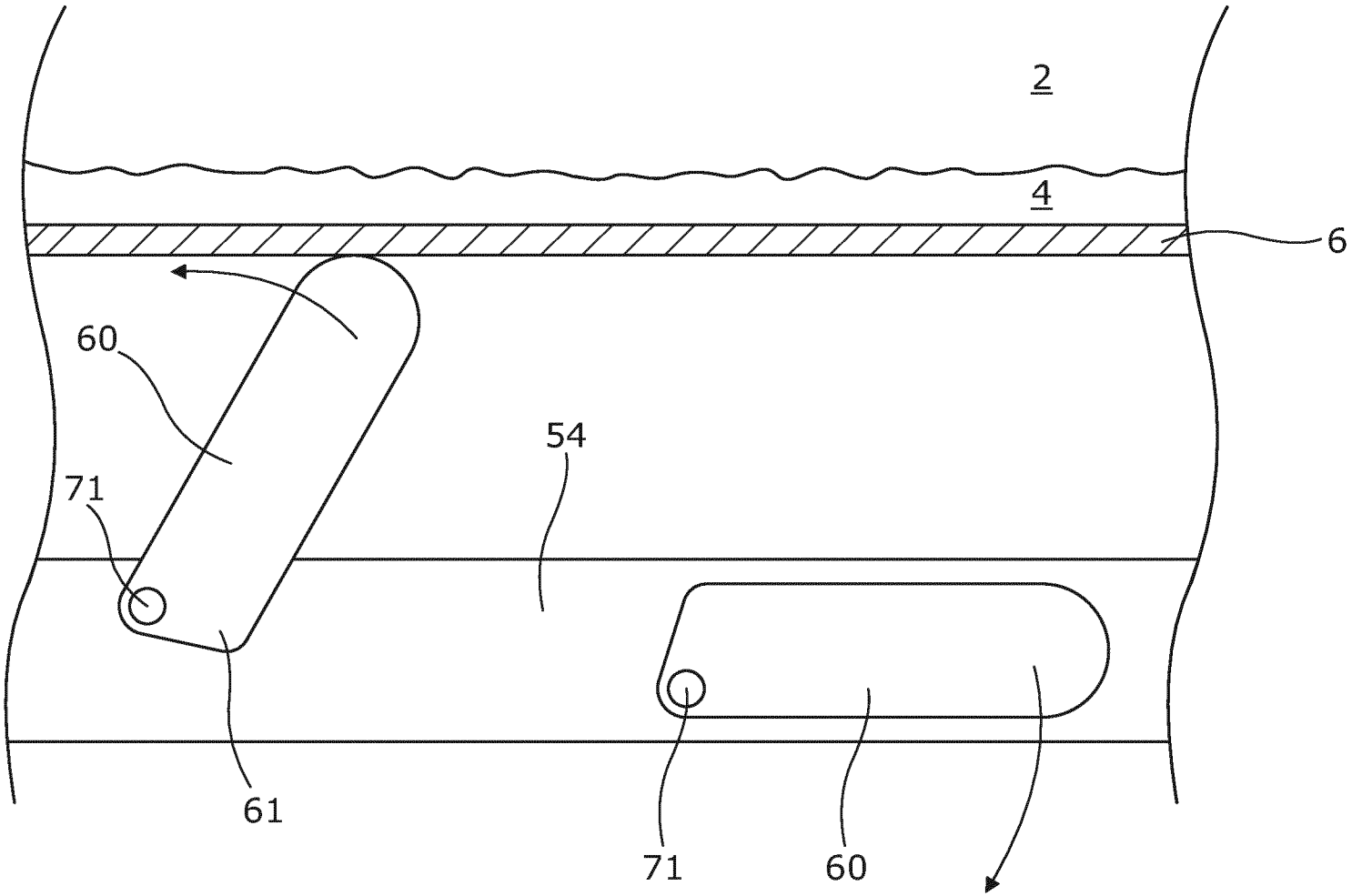
FIG. 6 shows, for illustrative purposes, a top view of part of a downhole tool with one arm assembly in a projecting position and another arm assembly in a retracted position.
Figure 8:
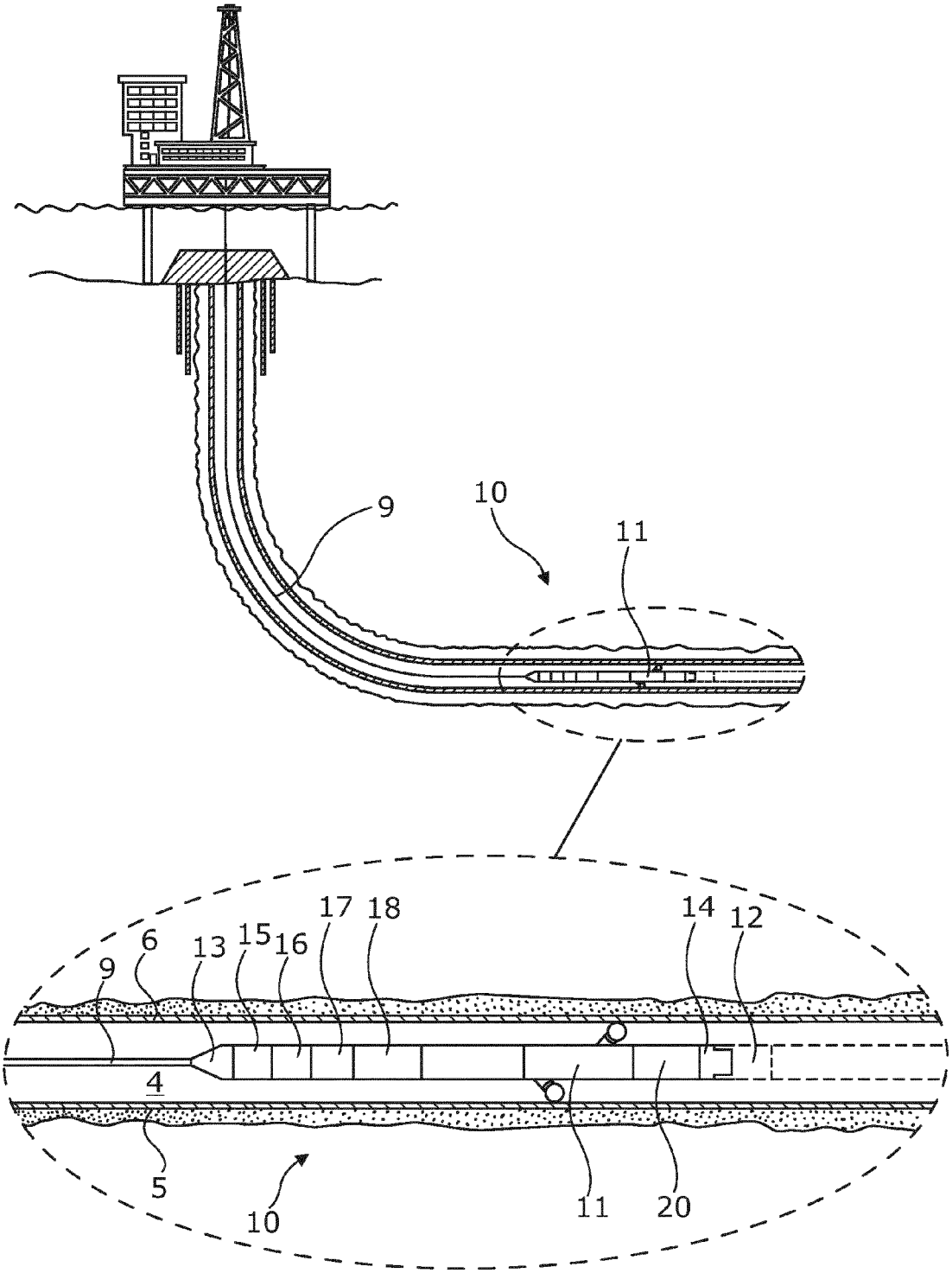
FIG. 8 shows a downhole system comprising an arm activation assembly for moving an arm assembly in a driving section.

FIG. 1 shows an arm activation assembly 40 for moving an arm assembly 60 which is shown in FIG. 6 between a retracted position and a projecting position. The arm activation assembly 40 is arranged in a tool housing 54 of a downhole tool being part of a tool string 10. An example of such tool string is shown in FIG. 8. The arm activation assembly 40 comprises a piston housing 41, a piston chamber 42 extending in a longitudinal direction of the downhole tool. A piston member 47 is arranged inside the piston chamber and the piston member is engaged with the arm assembly. When the piston member 47 is moved back and forth in the longitudinal direction of the piston chamber, the piston member will move a crank arm 72 of an engaging crank 70. When moving the crank arm 72, a crank shaft 71 is rotated around a rotation axis 32, and hence the arm assembly is moved between a retracted position and a projecting position. The crank 70 connects the piston member 47 with the arm assembly converting a transverse motion of the piston member to a rotation force acting on the arm assembly. In an arm activation assembly of the downhole tool, the arm assembly may be directly connected with a piston member 47. As shown in the drawings, the crank arm is connected with the piston member by the crank arm being arranged in a recess in the piston member and engaging the piston member by engaging means 83. The crank arm may, however, be connected to the piston member in any suitable way known to the person skilled, such as by using a rack also known as a toothed rack or gear-rack, or a worm shaft or a sliding pivot joint.

The piston member is dividing the piston chamber into a first section 42*a* and a second section 42*b*, the first section being in fluid communication with an activation fluid channel 80. A hydraulic fluid such as oil may be injected through the fluid channel 80 into the first section 42*a* of the chamber 42, thereby applying a hydraulic pressure on a first piston face 48 of the piston member 47. A spring member 44 is arranged in the second section 42*b* of the chamber between a second piston face 49 of the piston member and a distal end face 42*d* of the piston chamber. The spring member 44 applies a spring force to the second piston face 49. The hydraulic fluid moves the piston in a first direction, and the spring member 44 moves the piston in a second direction opposite the first direction.

As shown, the arm activation assembly in FIG. 1 has the piston member 47 which may comprise a piston part 47*a* and a piston shaft part 47*b*. As shown, the spring member may then circumscribe the piston shaft part in such a way that the travel of the spring member 44 during compression and decompression is well controlled. Furthermore, the piston shaft part may engage a recess 82 in the piston housing 41 to further improve control of the travel of the piston member within the piston chamber. The control of the travel of the piston member is improved since a distal end of the piston shaft part abuts the walls of the recess during travel of the piston. The piston comprises a distal part 81 with a reduced diameter engageable with the spring member. Furthermore, the piston member may be connected with the arm assembly using a worm shaft, a rack or a pivot joint or a recess 471 in the piston member.

Figure 2:
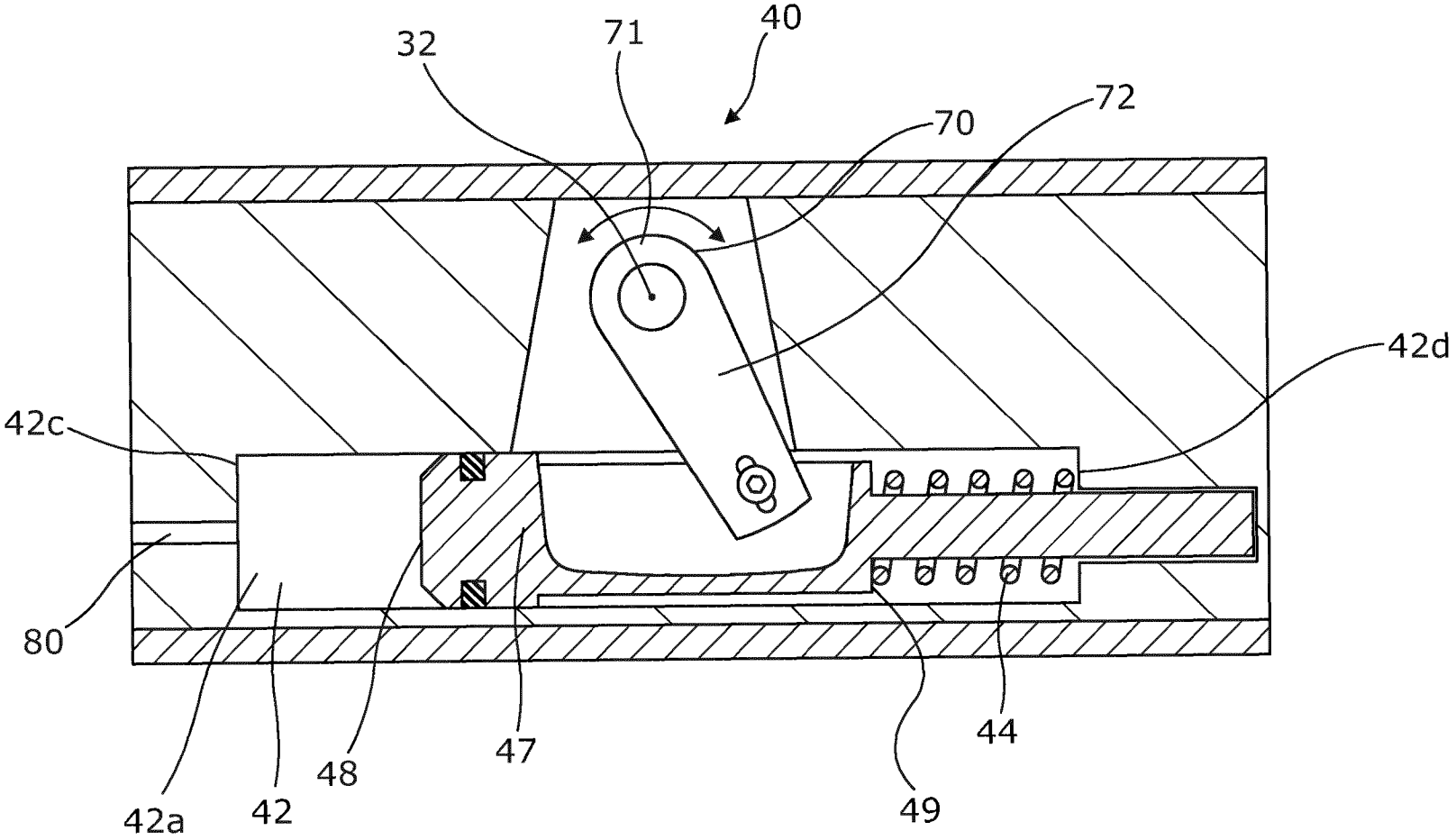
FIG. 2 shows a cross-sectional view of an arm activation assembly in a projecting position.

FIG. 2 shows the arm activation assembly in a projecting position. When the arm assembly needs to be projecting during downhole operations, a hydraulic pressure is applied to the first piston face 48 of the piston member 47 by pressurising a hydraulic fluid in the first section 42*a* of the piston chamber 42. When the hydraulic pressure is applied to the first piston face, the piston member moves towards the distal end face 42*d* of the piston chamber, thereby compressing the spring member 44. In order for the hydraulic pressure to move the piston member and thereby the arm activation assembly to the projecting position, the hydraulic pressure must exceed a spring force applied by the spring member 44 on the second piston face 49 and additional frictional forces stemming from the travel of the piston member in the piston chamber. Furthermore, the movement of the piston member results in a movement of the crank arm 72 since the piston member engages the crank arm. When the crank arm is moved in the longitudinal direction of the piston chamber towards the distal end face 42*d*, the crank shaft 71 will rotate around the rotation axis 32 of the crank 70.

Figure 3:
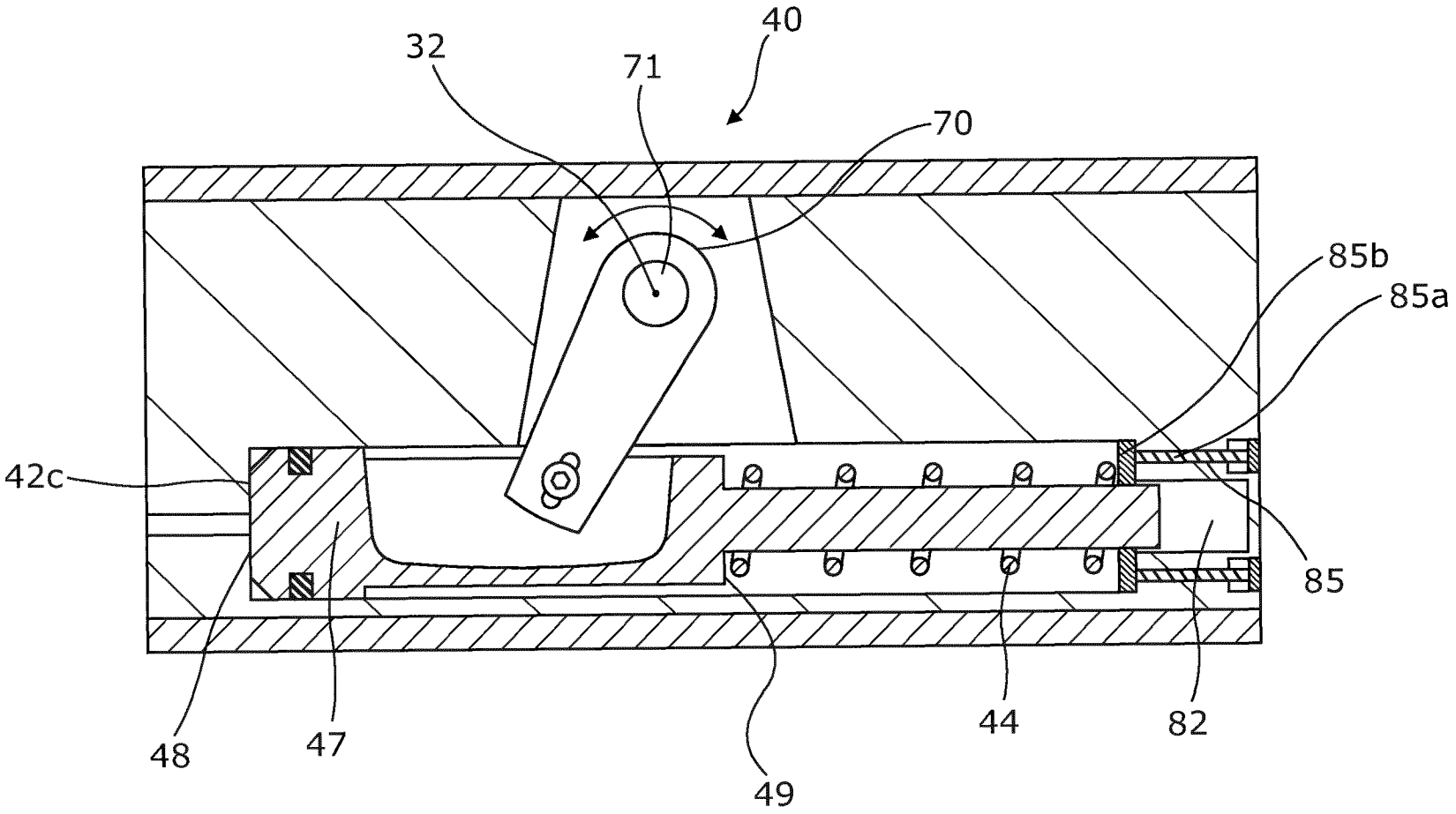
FIG. 3 shows a cross-sectional view of an arm activation assembly in a retracted position.

FIG. 3 shows the arm activation assembly in a retracted position. When the arm assembly needs to be retracted during downhole operations, the hydraulic pressure, which during projection was applied to a first piston face 48 of the piston member 47 by pressurising a hydraulic fluid in the first section, is then removed. When the hydraulic pressure is removed from the first section, the hydraulic pressure will no longer exceed the spring force applied by the spring member on the second piston face, and the piston member will therefore begin to move towards the distal end face 42*c* of the piston chamber forced by the spring member, thereby decompressing the spring member. In case of unintentional drops of hydraulic pressure in the first section of the chamber, the spring member acts as a fail-safe so that the tool can always be retracted from the well.

When working with downhole operations, jamming of downhole tools in a borehole is one of the most aggravating problems, which may cause downtime in the production, and even worse it may shut down a borehole if the jammed downhole tool cannot subsequently be removed. If the hydraulic pressure in the first section is lost, the arm activation assembly 40 will always move to a retracted position due to the spring member 44. Being unable to project the arm assembly with the arm activation assembly is of course inexpedient but it is not critical to the downhole operation since the tool string is merely retracted to the surface by a wireline 9 via a top connector 13 or a coiled tubing 9 connecting the tool string to the surface (shown in FIG. 8). Furthermore, a downhole tool may comprise several arm assemblies and if one does not project, others will.

In FIG. 3, the arm activation assembly 40 further comprises preloading means 85 for preloading the spring member 44. The preloading means allows assembly of the arm activation assembly with an uncompressed spring member 44, where the spring member then, subsequent to the assembly of the arm activation assembly, can be preloaded using the preloading means. The preloading means may comprise a screw 85*a* or a plurality of screws 85*a* and a washer 85*b*. Apart from making the assembly of the arm activation assembly more convenient, the preloading means may furthermore allow the user to preload, i.e. compress, the spring member to a certain degree to accommodate for certain requirements to the retraction mechanism of the arm activation assembly. An example of a situation demanding a high retraction force may be if the arm assembly has been used to anchor the tool string in a production casing or the borehole and therefore is sticking to the surface of the production casing or wall of the borehole. On the other hand, a lower retraction force may be needed if for example the arm assembly is used for wheels 62 in a driving section 11 (see FIG. 7). The retracting force in this situation may not necessarily have to be very high, and a low retraction force exerted by the spring member 44 may be more appropriate for providing a slower retraction of the wheels.

Figure 4:
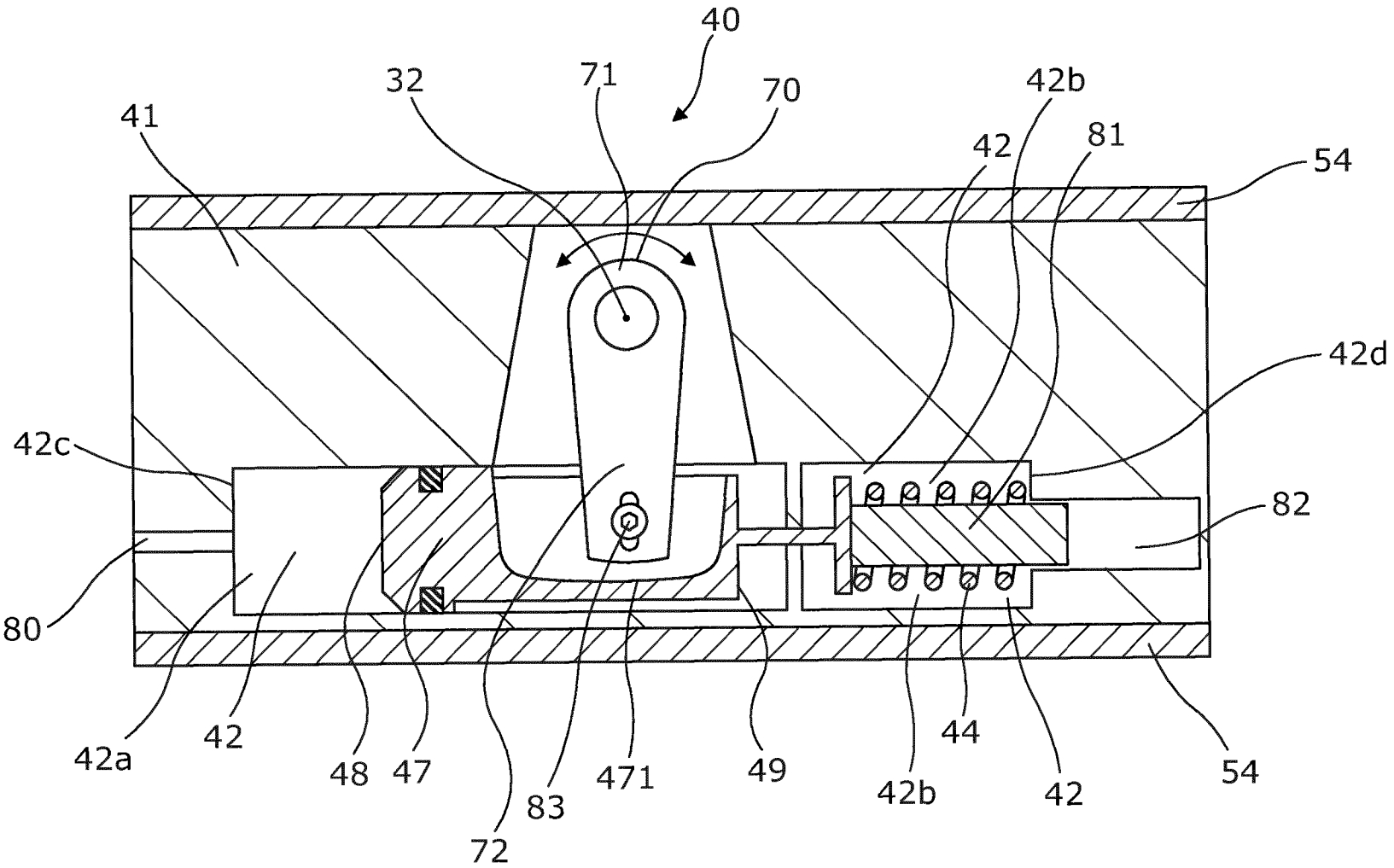
FIG. 4 shows a cross-sectional view of another embodiment of the arm activation assembly.

In the arm activation assembly shown in FIG. 4, the spring member is arranged in a spring chamber 42*a* and the piston is arranged in a piston chamber 42. The mounting of springs during production and/or maintenance of separable equipment including springs present a potential risk to the user. Therefore, enclosure of the spring member in a separate chamber may be advantageous to the handling and maintenance of such equipment, especially in a case where a very high preloading force of the spring is required.

Figure 5:
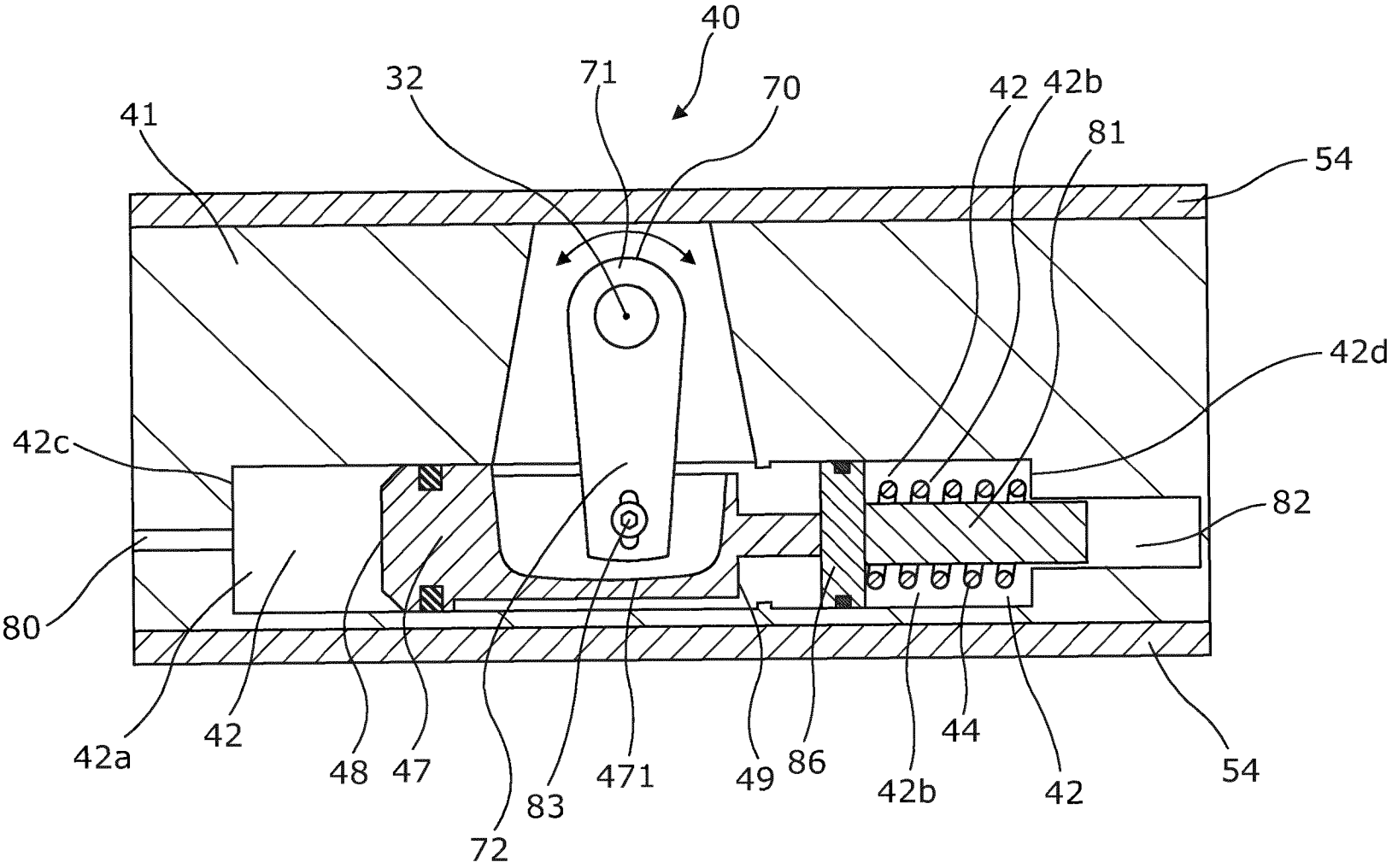
FIG. 5 shows a cross-sectional view of another embodiment of the arm activation assembly.

When the spring member is arranged in a separate chamber such as shown in FIG. 4 and FIG. 5, the spring force from the spring member still has to be capable of engaging the piston member in the piston chamber. In one embodiment, the piston shaft part may enter the spring chamber 42*a* through a connection hole between the piston chamber and the spring chamber such as shown in FIG. 4. Alternatively, the engagement of the piston member and the spring member may be facilitated by an intermediate piston member 86 sealing off the spring chamber as shown in FIG. 5.

FIG. 6 is an illustration of a part of the downhole tool with one arm assembly in a projecting position and another arm assembly in a retracted position. During downhole operations the arm assemblies of the downhole tool would typically all be in a projecting or a retracted position. The arm assembly may be used for several purposes during downhole operations such as tool centralising in the borehole 4 in a formation 2 or inside a production casing 6. Furthermore, an arm assembly may be used for anchoring, e.g. to ensure weight on bit during horizontal drilling, during downhole stroking or during operations perforating the production casing when setting up production zones.

The crank shaft may be connected to the arm member 61 by means such as a toothed crank shaft pattern mating with a similar pattern (not shown) in a bore in the arm member. The crank shaft and the arm member hereby interlock whereby the rotation force is transferred from the crank shaft to arm member.

Figure 7:
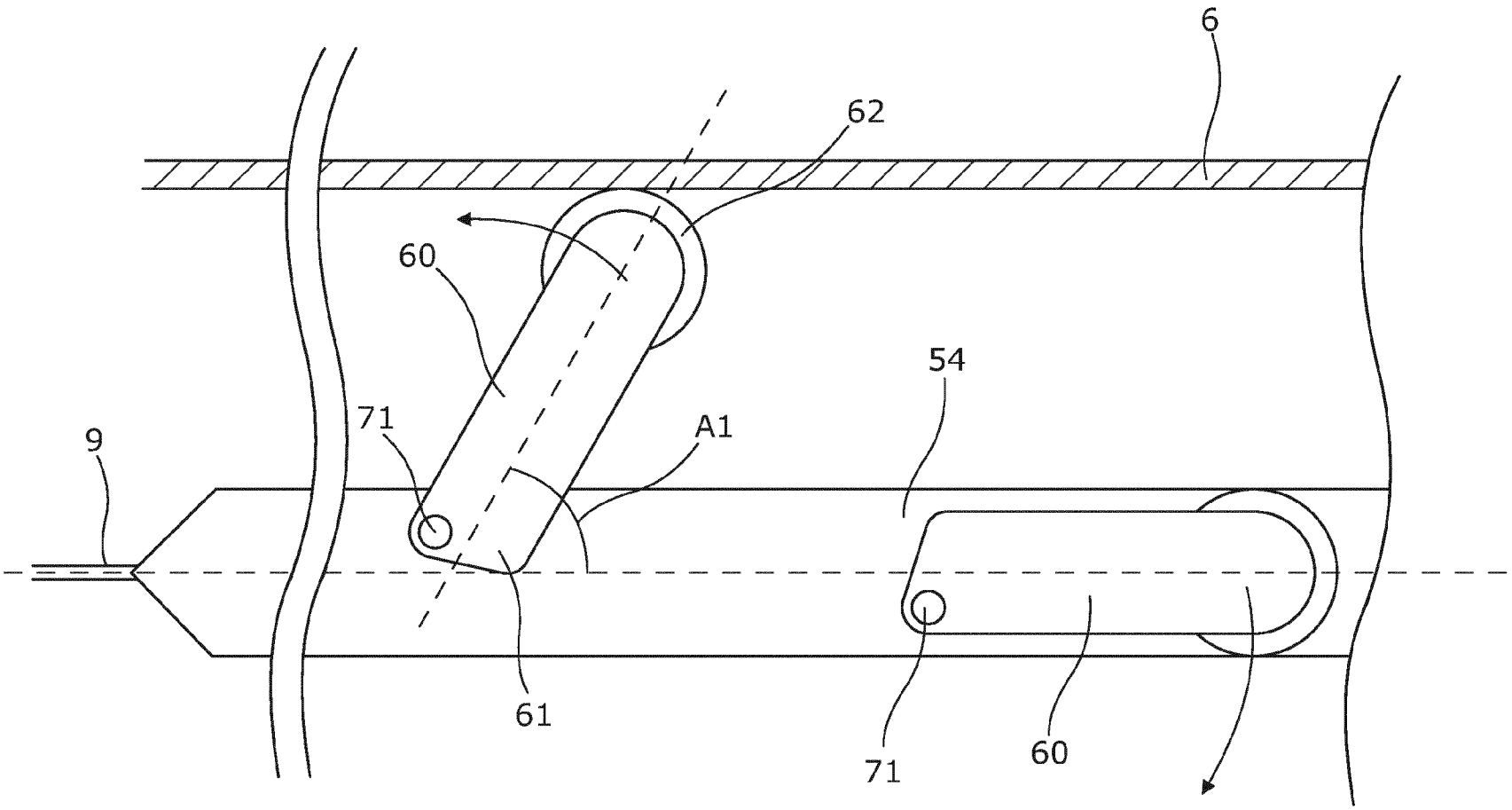
FIG. 7 shows, for illustrative purposes, a top view of part of a downhole tool with one arm assembly in a projecting position and another arm assembly in a retracted position, wherein the arm assemblies comprise a wheel.

FIG. 7 is another illustration of a part of the downhole tool with one arm assembly in the projecting position and another arm assembly in a retracted position. The arm assembly comprises an arm member and furthermore a wheel 62 for driving the tool string during downhole operations. An arm member 61 of the arm assembly 60 is seen in the left side of FIG. 7 in the projecting position and in this situation engaging an inner wall of a production casing 6. Furthermore, it is shown in FIG. 7 that an elongate axis of the arm member 61 has a projection angle A1 of less than ninety degrees with respect to the longitudinal axis of the tool string. In this way, the retraction of the arm assembly will not have a barbing function when pulling the wireline 9 or coiled tubing 9. Pulling the wireline or coiled tubing will therefore contribute to the retraction of the arm assembly if the projection angle is less than ninety degrees. As shown in FIG. 7, the crank shaft 71 is arranged away from a centre axis of the arm assembly. The intention is to be able to reach as far as possible away from the tool string, thereby being able to operate with larger casings.

The number of driving units 11 and/or the number of wheels 62 in a tool string may be varied depending on the required pulling force, e.g. high pulling force is required when operating a heavy tool string. Therefore, a number of arm activation assemblies and arm assemblies may be arranged in a driving unit and/or more than one driving unit may be arranged in the tool string.

The downhole tool string 10 shown in FIG. 8 comprises an electrical motor 17 for moving a hydraulic pump 18. The hydraulic pump 18 may be used to generate a pressurised hydraulic fluid. The driving unit 11 is connected with a compensating device 20 for compensating the pressure within the driving unit so that a high pressure difference between the fluid surrounding the tool string 10 and the inside of the tool string 10, e.g. the inside of the driving unit, does not result in the driving unit housing bulging outwards or collapsing inwards. The driving unit 11 may furthermore be connected with an operational tool 12 through a connector 14. The pressurised fluid may be injected through the fluid channel 80 and into the first section of the chamber to project the arm assembly by means of the arm activation assembly. The electric motor 17 may be powered from the surface by a wireline 9, or alternatively the electric motor may be powered by batteries (not shown) arranged in the tool string. During coiled tubing operations well-known to any person skilled in the art, the hydraulic pump may be replaced by a hydraulic pump at the surface generating a pressurised fluid at the surface which is pumped through a coiled tubing 9 to the downhole tool string. Coiled tubing operations are typically limited to smaller depths of boreholes due to the weight of the coiled tubing. At very large depths and in horizontal parts of the well, wireline operations are therefore more appropriate than coiled tubing operations.

Figure 9:
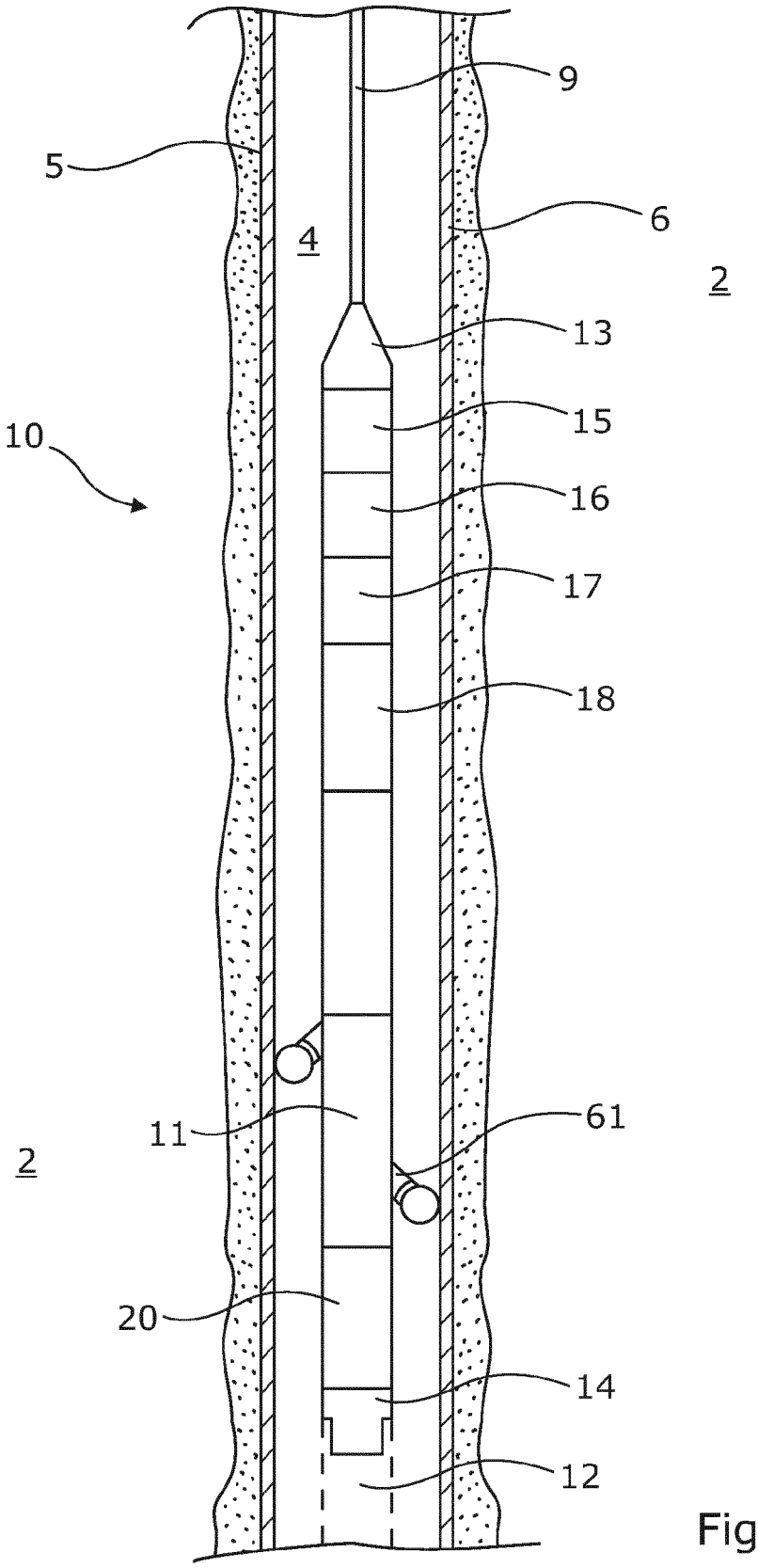
FIG. 9 shows a tool string comprising an arm activation assembly for moving an arm assembly in a driving section.

The shown tool string comprises a downhole tool in the form of a driving unit 11 for moving the tool string forward downhole. The downhole tool extends in a longitudinal direction and comprises a tool housing, arm assemblies and arm activation assemblies. The tool string shown in FIG. 9 is moved forward by several wheels projecting towards the casing or side walls of the well. The wheels are mounted on the arm member 61 in such a way that they can be moved between a retracted position and a projecting position. When the wheels turn, the tool string is moved forward deeper into the hole, and typically the wireline or the coiled tubing is used to retract the tool string back towards the surface, since it is faster than using downhole propagation means such as the driving unit.

Figure 10:
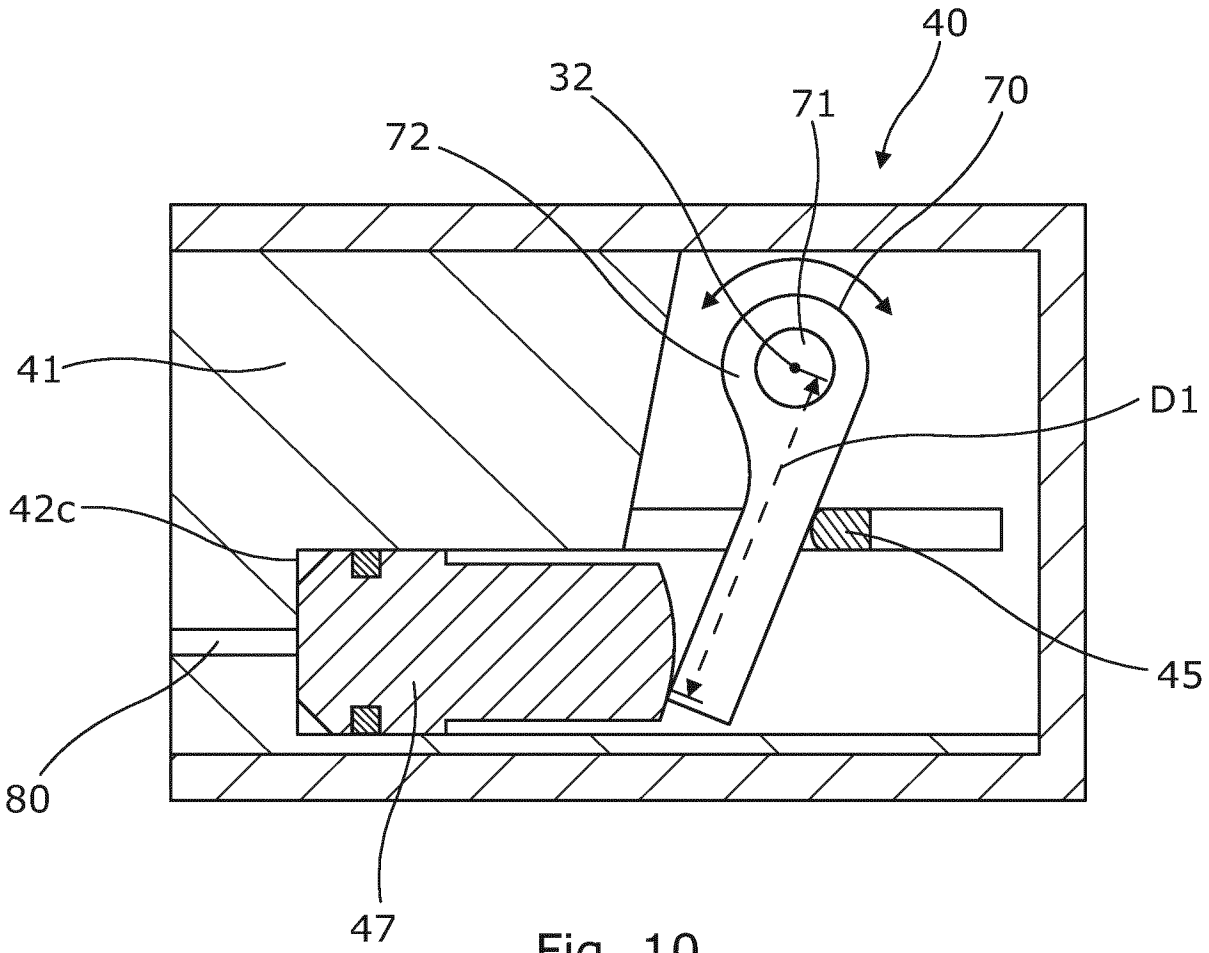
FIG. 10 shows a cross-sectional view of an arm activation assembly.
Figure 11:
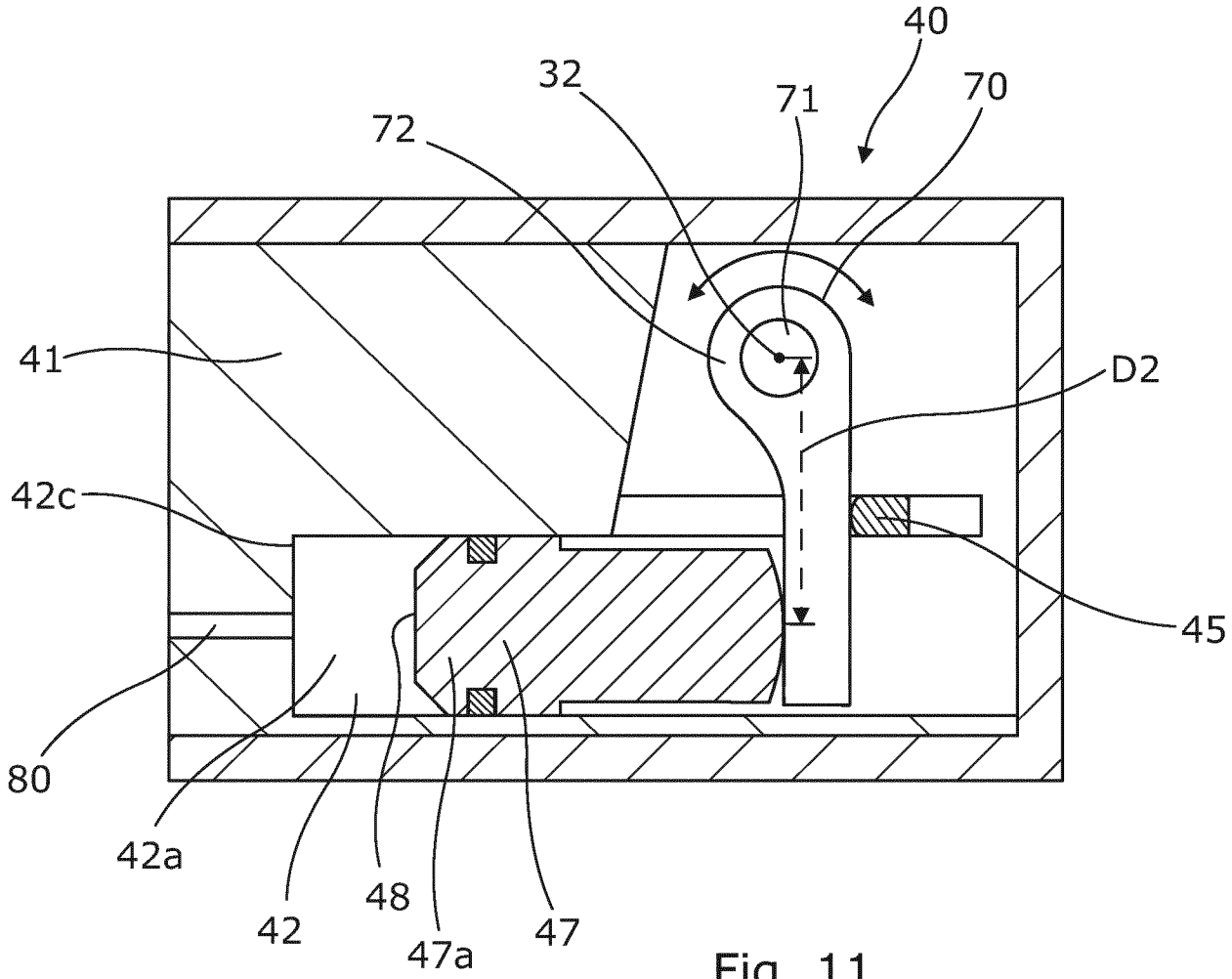
FIG. 11 shows a cross-sectional view of an arm activation assembly.
Figure 12:
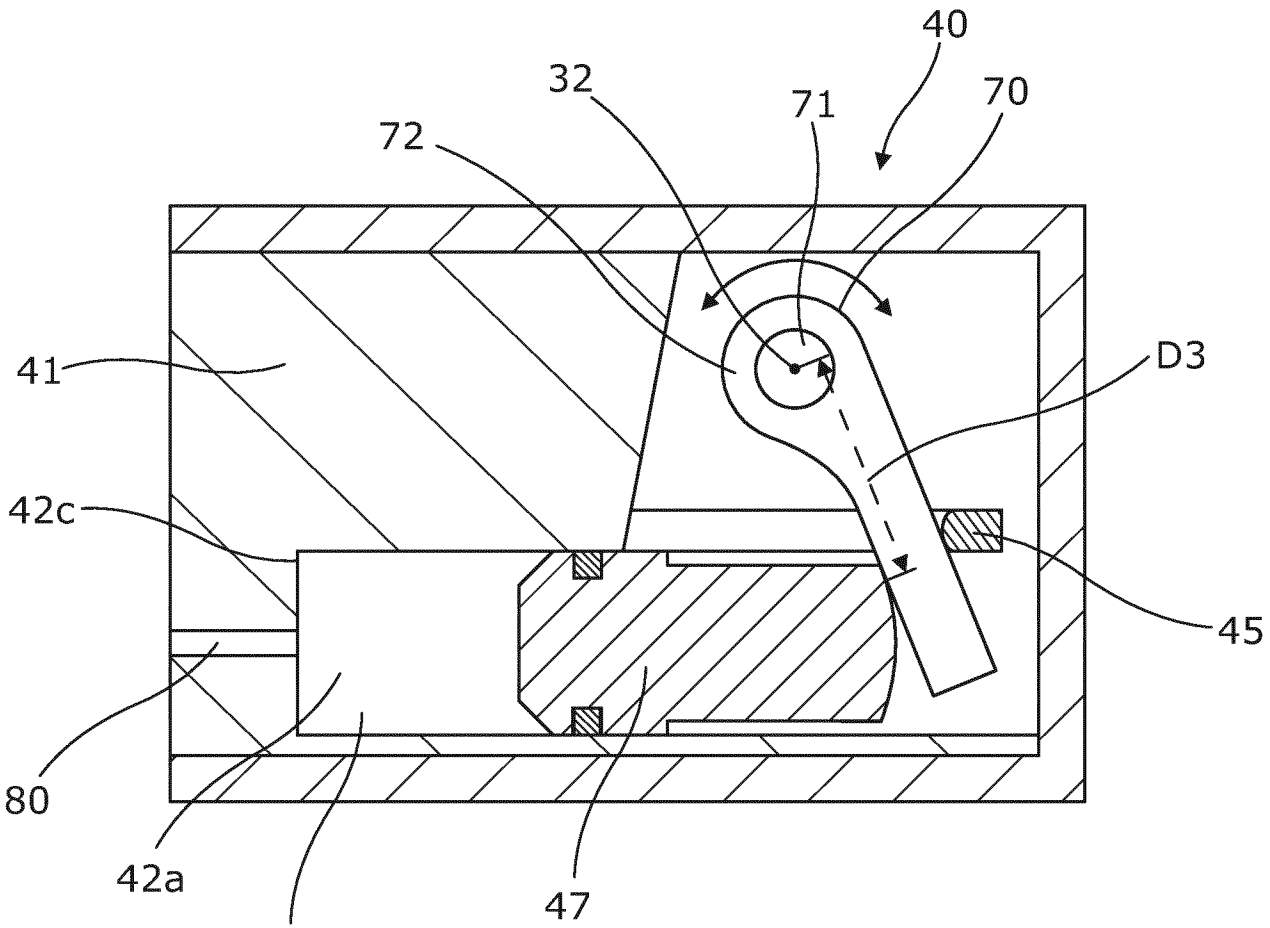
FIG. 12 shows a cross-sectional view of an arm activation assembly.

FIGS. 10-12 show cross-sectional views of the arm activation assembly 40 in a retracted position (see FIG. 10), in an intermediate position (see FIG. 11) and in a projecting position (see FIG. 12). As shown in FIGS. 10-12, the spring member may be arranged in a different chamber than the piston member 47. In order to minimise the use of space in the downhole tool in the longitudinal direction, the spring member may be arranged substantially side-by-side the piston member 47 (see FIGS. 13*a* and 13*b*) instead of substantially end-to-end (see FIGS. 1-5). If the spring member and piston member 47 are arranged side-by-side, the spring member may apply a retracting force to the crank arm 72 by an intermediate member 45. Alternatively, the spring member may apply a retracting force directly to the arm assembly (not shown).

As shown in FIGS. 10-12, the distance D1, D2, D3 between the rotation axis 32 and a point of contact between the crank arm 72 and the piston member 47 is preferably longer in the retracted position than in the projecting position, meaning that a resulting projecting force applied to the arm assembly by the arm activation assembly 40 is decreasing from a high resulting projection force in the retracted position towards a lower resulting projection force in the projecting position. This decreasing resulting projecting force ensures that the tool string is well centralised in the production casing during projection of the arm assembly, i.e. the further out the arm assembly is projecting, the smaller the resulting projecting force is. This means that the resulting force will always be highest on the parts of the arm assembly which are less projecting, thereby always ensuring that the tool string will automatically be well centralised in the production casing or well bore.

Figure 13A:
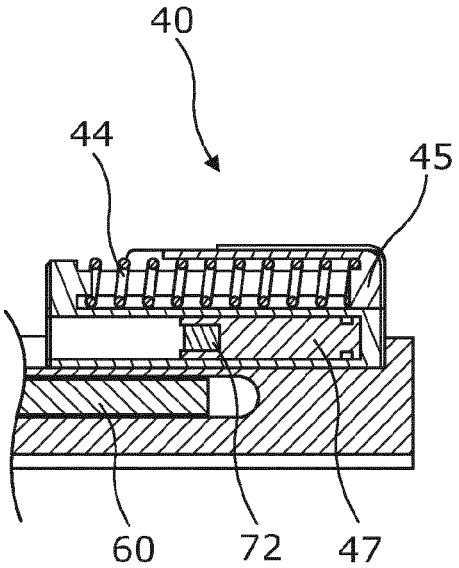
FIG. 13*a* shows a cross-sectional view of an arm activation assembly in a retracted position.
Figure 13B:
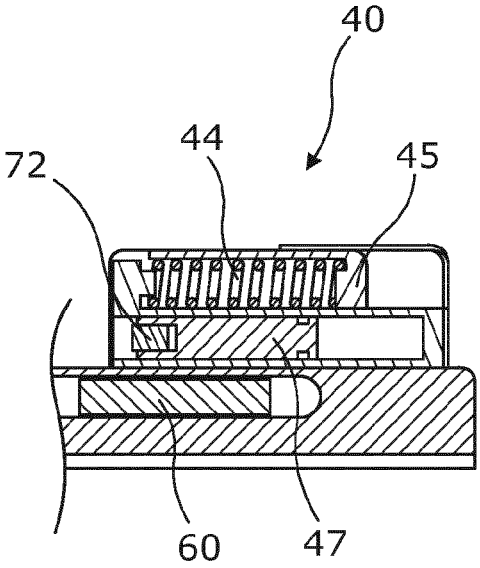
FIG. 13*b* shows a cross-sectional view of an arm activation assembly in a projecting position.
Figure 14A:
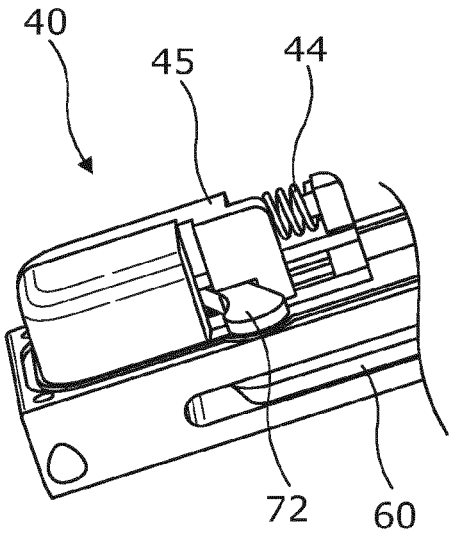
FIG. 14*a* shows a perspective view of an arm activation assembly and an arm assembly in a retracted position.
Figure 14B:
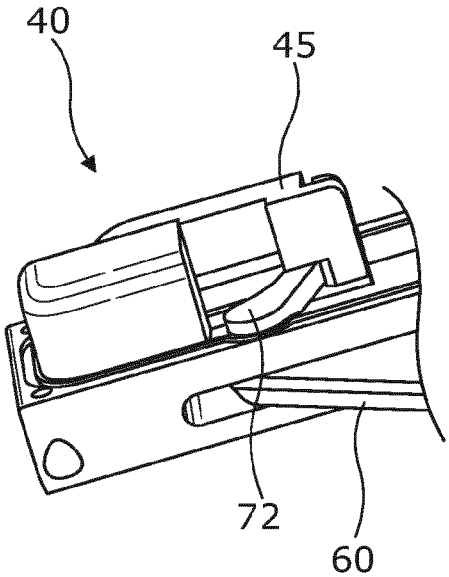
FIG. 14*b* shows a perspective view of an arm activation assembly and an arm assembly in a projecting position.

FIG. 13*a* shows a cross-sectional view of an arm activation assembly 40 in a retracted position, where the piston member 47 and spring member 44 are arranged substantially side-by-side in the longitudinal direction of the tool string. As seen, this may save space in the longitudinal direction. In embodiments where the spring member 44 is not arranged in direct contact with the piston member 47, an intermediate member 45, such as the one shown in FIGS. 13*a*, 13*b*, 14*a* and 14*b*, may be arranged between the piston member 47 and spring member 44. Thereby the spring member 44 is still allowed to apply the spring force opposite the projection force of the piston member to provide fail-safe retraction of the arm assembly 60. FIG. 13*b* shows a cross-sectional view of the arm activation assembly 40 of FIG. 13*a* in a projecting position. FIGS. 14*a* and 14*b* show perspective views of the downhole tool shown in FIGS. 13*a* and 13*b*, also in a retracted and projecting position, respectively. As shown in FIGS. 14*a* and 14*b*, the spring member 44 is not required to be arranged in a confined chamber as long as the spring force acts opposite the projecting force so that the arm assembly 60 is retracted if hydraulic pressure on the piston member 47 is lost, ensuring a fail-safe retraction mechanism independent of hydraulic pressure in the tool.

The fluid transferred into the first section of the chamber may be branched out through other fluid channels to reach an adjacent arm activation assembly (not shown) in a driving unit. The arm activation assembly may thus comprise an integrated fluid circuit in the form of fluid channels provided in the walls of the piston housing. Several activation assemblies may then be combined to provide a larger fluid circuit without the need of external piping connecting the individual activation assemblies. Fluid channels of subsequent piston houses are joined by connectors (not shown) creating tight fluid joints.

The spring member 44 may be any type member exerting a spring force on the second piston face 49 such as a coil spring, helical spring, bellow, volute spring, leaf spring, gas spring or disc spring. The spring type may be used for designing an appropriate spring force exerted on the piston member such as a constant spring force or a spring force that increases during projection of the arm assembly, so that the highest spring force is obtained at the outermost position of the arm assembly.

By introducing intelligent sensors 84 (shown in FIG. 1) such as pressure gauges, switches for determining position of the piston member 47 and/or crank arm 72, feedback signals may be fed back to the user and/or to controlling electronics 15, 16 in the tool string (shown in FIG. 8).

Although the invention has been described in the above in connection with preferred embodiments of the invention, it will be evident for a person skilled in the art that several modifications are conceivable without departing from the invention as defined by the following claims.

The invention claimed is:

1. A downhole tool extending in a longitudinal direction, comprising:

a tool housing;

a plurality of arm assemblies movable between a retracted position and a projecting position in relation to the tool housing; and a plurality of arm activation assemblies, one for each arm assembly for moving the arm assembly between the retracted position and the projecting position;

a wheel mounted on each of the arm assemblies and projecting towards a casing or side walls of a well, to move the tool string forward downhole, the plurality of arm assemblies extendable in different directions radially outwards from the tool housing, wherein the arm activation assembly of each arm assembly comprises:

a piston housing comprising a piston chamber, said piston chamber extending in the longitudinal direction of the downhole tool, a piston member arranged inside the piston chamber and engaged with the arm assembly to move the arm assembly between the retracted position and the projecting position, the piston member being movable in the longitudinal direction of the downhole tool and having a first piston face and a second piston face, the piston member being able to apply a projecting force on the arm assembly by applying a hydraulic pressure on the first piston face moving the piston in a first direction, and a spring member for each arm activation assembly applying a spring force to move the piston in a second direction opposite the first direction so that in case of unintentional drops of hydraulic pressure on the first piston face, the spring member acts as a fail-safe spring retracting the arm assembly.

2. A downhole tool according to claim 1, wherein the arm activation assembly comprises a fluid channel and the hydraulic pressure is applied to the first piston face with a pressurised hydraulic fluid through the fluid channel.

3. A downhole tool according to claim 1, wherein the spring member is arranged in a spring chamber and the piston is arranged in the piston chamber.

4. A downhole tool according to claim 1, wherein the piston housing comprises a recess for receiving part of a piston shaft when the piston moves.

5. A downhole tool according to claim 4, wherein the piston shaft extends in the piston chamber and into a spring chamber.

6. A downhole tool according to claim 5, wherein the piston chamber and spring chamber are arranged substantially side-by-side in the longitudinal direction of the tool.

7. A downhole tool according to claim 4, wherein the piston chamber and a spring chamber are arranged substantially end-to-end in the longitudinal direction of the tool.

8. A downhole tool according to claim 1, wherein the piston member divides the piston housing into a first and a second section, the first section being filled with fluid for moving the piston member.

9. A downhole tool according to claim 1, further comprising a pump for pressurising the pressurised hydraulic fluid for moving the piston in the first direction.

10. A downhole tool according to claim 1, wherein the downhole tool is connected with a wireline and an electrical motor is powered through the wireline.

11. A downhole tool according to claim 1, wherein the downhole tool comprises several arm assemblies and arm activation assemblies and each of the arm assemblies are moved by one of the arm activation assemblies.

12. A downhole tool according to claim 1, wherein the piston comprises a distal part with a reduced diameter engageable with the spring member.

13. A downhole tool according to claim 1, further comprising electrical sensors for monitoring a position of the piston member for producing a feedback signal to a control system.

14. A downhole tool according to claim 1, wherein the spring member is preloaded before being compressed by the piston during application of the hydraulic pressure on the first piston face moving the piston in a first direction.

15. A downhole tool according to claim 1, wherein the piston member is connected with the arm assembly using a worm shaft, a rack or a pivot joint or a recess in the piston member.

16. A downhole tool according to claim 1, wherein the arm activation assembly comprises a crank arm, meaning that when the piston member is moved back and forth in the longitudinal direction of the piston chamber, the piston member will move the crank arm, and when the crank arm is moved, a crank shaft is rotated around a rotation axis, and hence the arm assembly being connected to the crank shaft is moved between a retracted position and a projecting position, and wherein a force arm distance between the rotation axis of the crank arm and a point of contact between the crank arm and the piston member is longer in the retracted position than in the projecting position, meaning that a resulting projecting force applied to the arm assembly by the arm activation assembly is decreasing from a high resulting projection force in the retracted position towards a lower resulting projection force in the projecting position.

17. A downhole system, comprising:

a wireline, a mating tool, and a downhole tool according to claim 1.

18. A downhole system according to claim 17, wherein the mating tool comprises a driving unit and/or an operational tool.

* * * * *